US005784975A

United States Patent [19]

Tanca

[11] Patent Number: 5,784,975

[45] Date of Patent: Jul. 28, 1998

[54] CONTROL SCHEME FOR LARGE CIRCULATING FLUID BED STEAM GENERATORS (CFB)

[75] Inventor: Michael C. Tanca, Tariffville, Conn.

[73] Assignee: Combustion Engineering, Inc., Windsor, Conn.

[21] Appl. No.: 771,998

[22] Filed: Dec. 23, 1996

[51] Int. Cl.[6] ..... F23G 5/00; F23G 7/00

[52] U.S. Cl. ..... 110/245; 122/4 D

[58] Field of Search ..... 122/4 D; 110/245, 110/345

[56] References Cited

U.S. PATENT DOCUMENTS 4,747,356 5/1988 Beisswenger et al. ..... 110/245
4,962,711 10/1990 Yamauchi et al. ..... 110/245
5,159,886 11/1992 Schaub et al. ..... 110/245
5,273,000 12/1993 Regan ..... 122/4 D
5,463,968 11/1995 Abdulally ..... 110/245
5,526,775 6/1996 Hyppanen ..... 110/245

*Primary Examiner*—Henry A. Bennett
*Assistant Examiner*—Jiping Lu
*Attorney, Agent, or Firm*—Arthur E. Fournier, Jr.

[57] ABSTRACT

A control scheme for large circulating fluidized bed steam generators (CFB) wherein direct control is effected therewith over the temperature of the large circulating fluidized bed steam generators (CFB) and wherein independent control is effected therewith over the final superheat steam temperature of the large circulating fluidized bed steam generators (CFB) as well as over the final reheat steam temperature of the large circulating fluidized bed steam generators (CFB).

10 Claims, 4 Drawing Sheets

CONTROL SCHEME FOR LARGE CIRCULATING FLUID BED STEAM GENERATORS (CFB)

BACKGROUND OF THE INVENTION

This invention relates to fossil fuel-fired circulating fluidized bed steam generators (CFB), and more specifically to effecting direct control of the temperature of such a fossil fuel-fired circulating fluidized bed steam generator (CFB) as well as to effecting indirect control of the final superheat steam temperature and of the final reheat steam temperature of such a fossil fuel-fired circulating fluidized bed steam generator (CFB).

It has been known heretofore in the prior art to provide fluidized bed steam generators of various types. In this regard, one convenient method of differentiating between such various types of fluidized bed steam generators is by the nature of the fluidization that takes place therewithin. As employed in this context, the term "fluidization" refers to the manner in which solid materials are provided with a free-flowing, fluid-like behavior. To this end, as a gas is made to pass upwardly in a fluidized bed steam generator through a bed of solid particles that is present therewithin, such a flow of gases produces forces that tend to separate the solid particles one from another. At low gas velocities such forces can be insufficient to cause the solid particles to separate one from another such that the solid particles remain in contact with one another, i.e., tend to resist movement therebetween. When such a condition exists, it is referred to as being a fixed bed. As such, fluidized bed steam generators in which such a condition exists are commonly referred to in the art as being fixed bed fluidized bed steam generators.

On the other hand, as the gas velocity is increased, a point is reached wherein the gas velocity is sufficient such that the forces acting upon the solid particles are adequate to cause separation of the solid particles. When this occurs, the bed of solid particles then become fluidized in that the gas cushion between the solid particles permit the solid particles to move freely, thus giving the bed of solid particles liquid-like characteristics.

The design of fluidized bed steam generators is generally such that for purposes of the combustion process that takes place therewithin, fuel is burned in a bed of hot incombustible particles, the latter particles being suspended by an upwardly flow of fluidizing gas. Moreover, this fluidizing gas normally is comprised of both air, which is being supplied to the fluidized bed steam generator to support the combustion of fuel therewithin, and the gaseous byproducts, which result from such combustion of fuel and air.

Fluidized bed steam generators, including but not limited to circulating fluid bed steam generators (CFB), are normally intended to be operative to produce steam. Moreover, such production of steam results from the combustion of fuel and air within the fluidized bed steam generators. Furthermore, the steam that is so produced within the fluidized bed steam generator is designed to be operative to function in accordance with a preselected thermodynamic steam cycle.

Inasmuch as the subject matter of the instant application relates in particular to circulating fluidized bed steam generators (CFB), the discussion hereinafter will be presented in the context of a circulating fluidized bed steam generator (CFB). To this end, a circulating fluidized bed steam generator (CFB) includes a furnace volume, the walls of which are comprised of vertical waterwall tubes. In the lower segment of the furnace volume, fuel and sorbent are mixed with and burned in air, producing hot combustion gases in which hot solids become entrained. As these hot combustion gases and hot solids entrained therewithin rise within the furnace volume, heat is transferred to the aforementioned waterwall tubes thereby causing saturated steam to be evaporatively produced in conventional fashion from the water rising within the waterwall tubes. This saturated steam is a mix of steam and water, which is thereafter separated in known fashion in a steam drum. From the steam drum, the water is returned to the waterwall tubes in the lower segment of the furnace volume thereby completing an evaporative loop, while the steam is delivered to a superheater to which further reference will be had hereinafter.

From the top of the furnace volume, the hot combustion gases and hot solids entrained therewithin are directed to a cyclone where unburned fuel, flyash and sorbent above a predetermined size are mechanically separated from the hot combustion gases. This unburned fuel, flyash and sorbent are collected from the cyclone, then are made to fall under the influence of gravity through a stand pipe and a seal pot, and are thereafter reintroduced into the lower segment of the furnace volume whereupon this unburned fuel, flyash and sorbent are once again subjected to the combustion process. The foregoing describes the circulation path followed by the hot solids, which are above a predetermined size, that become entrained in the hot combustion gases.

The hot combustion gases entering the cyclone, which hereinafter will be referred to as flue gases, still contain useful energy, and after separation therefrom of unburned fuel, flyash and sorbent above a predetermined size, are directed to a backpass, with which the circulating fluidized bed steam generator (CFB) is suitably provided, wherein additional heat exchange surfaces are located. These additional heat exchange surfaces commonly comprise superheat surface followed by possibly reheat surface and thereafter economizer surface. The superheat surface in known fashion is operative to heat, i.e., superheat, the steam, which as described hereinbefore has been separated from the water in the steam drum of the circulating fluidized bed steam generator (CFB), whereupon this steam, which has been subjected to superheating, is made to flow to a high pressure turbine (HPT). After expansion in the high pressure turbine (HPT), the aforementioned steam, which has been subjected to superheating, is made to flow to the reheat surface, if such reheat surface has been provided in the backpass of the circulating fluidized bed steam generator (CFB). The reheat surface is operative in known fashion to once again heat, i.e., reheat, the steam, which as described hereinbefore has been separated from the water in the steam drum of the circulating fluidized bed steam generator (CFB), whereupon this steam, which has been subjected to reheating, is made to flow to a low pressure turbine (LPT).

Continuing, after further expansion in the low pressure turbine (LPT), the aforereferenced steam, which has been subjected to reheating, is condensed to water, whereupon the water that results from condensing of the reheated steam is made to flow to the economizer surface, which is located in the backpass of the circulating fluidized bed steam generator (CFB), where this water is heated before being returned to the steam drum of the circulating fluidized bed steam generator (CFB). The foregoing completes the description of the thermodynamic steam cycle of the steam, which is produced from the combustion process that takes place within the circulating fluidized bed steam generator (CFB). In closing, however, note is made herein of the fact that at appropriate points relative to the superheat surface and to the reheat surface, which are located in the backpass of the circulating fluidized bed steam generator (CFB), water spray stations are provided that are used to control the temperature of the superheat steam, which flows to the high pressure turbine (HPT), and/or to control the temperature of the reheat steam, which flows to the low pressure turbine (LPT). The water, which is employed in these water spray stations, is extracted from the water, which is produced from the condensing of the reheat steam, that is made to flow to the economizer surface located in the backpass of the circulating fluidized bed steam generator, and as such the water, which is employed in these water spray stations, is, therefore, not available for use in generating steam.

The flue gases during the passage thereof through the backpass of the circulating fluidized bed steam generator (CFB) are cooled as a consequence of the heat exchange that occurs between the flue gases and the superheat surface, the reheat surface (if present), and the economizer surface, which are located in the backpass of the circulating fluidized bed steam generator (CFB). Upon exiting from the backpass of the circulating fluidized bed steam generator (CFB), the now cooler flue gases are then preferably utilized in known fashion to effect therewith a preheating of the air, which is supplied to the circulating fluidized bed steam generator (CFB) for the purpose of accomplishing therewith the combustion of fuel within the circulating fluidized bed steam generator (CFB). Thereafter, the flue gases also in known fashion are generally made to flow to and through a particulate removal system for purposes of effecting the removal of particulates from the flue gases after which the flue gases are emitted to the atmosphere from a stack, which is cooperatively associated with the circulating fluidized bed steam generator (CFB). The foregoing completes the description of the path of flow of the flue gases, the latter being generated from the combustion of fuel and air within the circulating fluidized bed steam generator (CFB).

It has been found that as circulating fluidized bed steam generators (CFB) grow in size, the capacity to transfer heat to the waterwall tubes that serve to define the volume of the furnace of the circulating fluidized bed steam generator (CFB) diminishes geometrically. This is attributable to the decrease in the ratio of the surface area of the waterwall tubes of the furnace to the volume of the furnace. Thus, the result is that it becomes no longer possible to generate a sufficient amount of steam by evaporation in the waterwall tubes of the furnace of the circulating fluidized bed steam generator (CFB), which steam can then be supplied to the steam drum of the circulating fluidized bed steam generator (CFB), and concomitantly to provide a sufficient amount of steam to enable completion of the desired thermodynamic steam cycle to be accomplished therewith.

To compensate for this diminishing capacity to generate a sufficient amount of steam by evaporation in the waterwall tubes of the circulating fluidized bed steam generator (CFB), a pair of cyclones, acting in parallel with one another and each having a fluidized bed heat exchanger (FBHE) cooperatively associated therewith, can be provided in the circulation flow path of the hot solids, which are produced during operation of the circulating fluidized bed steam generator (CFB). By way of background, the term fluidized bed heat exchanger as employed herein is intended to refer to a closed compartment, which is thermally isolated from its surroundings and which is designed to be operative to enable heat to be exchanged therewithin between a hot medium and a cool medium. In the present instance, the hot medium comprises the hot solids, which are produced during operation of the circulating fluidized bed steam generator (CFB), and the cool medium comprises the steam or water of the thermodynamic steam cycle of the circulating fluidized bed steam generator (CFB). When such fluidized bed heat exchangers (FBHE) are so provided, a portion of the hot solids, which are produced during operation of the circulating fluidized bed steam generator (CFB) are diverted to and made to flow through the fluidized bed heat exchangers (FBHE) before the hot solids, which have been diverted, are reintroduced into the furnace volume of the circulating fluidized bed steam generator (CFB).

The aforementioned fluidized bed heat exchangers (FBHE) as such are capable of being employed to perform therewithin some portion of the duty of the thermodynamic steam cycle of the circulating fluidized bed steam generator (CFB). By way of exemplification and not limitation in this regard, one such fluidized bed heat exchanger (FBHE) may embody superheat surface whereby superheat steam may be made to pass through this fluidized bed heat exchanger (FBHE) for purposes of enabling there to be accomplished therewithin final superheat of this superheat steam before such superheat steam flows to the high pressure turbine (HPT) and/or another one of such fluidized bed heat exchangers (FBHE) may embody reheat surface whereby reheat steam may be made to pass through this fluidized bed heat exchanger (FBHE) for purposes of enabling there to be accomplished therewithin final reheat of this reheat steam before such reheat steam flows to the low pressure turbine (LPT). In addition to embodying superheat surface or reheat surface, each such one of these fluidized bed heat exchangers (FBHE) may also embody evaporative surface, which is designed to be operative to make up for the diminished capacity to produce steam by evaporation in the waterwall tubes of the furnace volume, which has been the subject of discussion hereinbefore. Such evaporative surface, which would be connected in fluid flow relation with the waterwall tubes of the furnace volume, preferably would be provided in the aforereferenced fluidized bed heat exchangers (FBHE) downstream of the superheat surface or the reheat surface, as the case may be, which is also provided therewithin.

A control scheme capable of being used with such an arrangement wherein fluidized bed heat exchangers (FBHE) are utilized as a means of offsetting the diminished capacity to produce steam by evaporation in the waterwall tubes of the furnace volume would typically involve monitoring of the final superheat steam temperature and of the final reheat steam temperature. Based on such monitoring of the final superheat steam temperature and of the final reheat steam temperature, signals would be generated representative of the final superheat steam temperature and of the final reheat temperature, and these signals would then be fed back to controllers. Such controllers are designed to be operative to effect control over valves suitably provided within the circulation flow path of the hot solids, which are produced during operation of the circulating fluid bed steam generator (CFB), so as to be located upstream of the fluidized bed heat exchangers (FBHE). The position of these valves is established in response to the signals representative of the final superheat steam temperature and of the final reheat steam temperature, which are received by the controllers. In turn, the position of these valves establishes the mass flow rate of the hot solids, which are diverted into the fluidized bed heat exchangers (FBHE), and concomitantly the temperature of the final superheat steam and the temperature of the final reheat steam. However, due to the lack of thermal isolation within the fluid bed heat exchangers (FBHE) between the evaporative surface provided therewithin and the superheat surface or reheat surface, as the case may be, provided therewithin, the temperature of the evaporative steam within the fluidized bed heat exchangers (FBHE) cannot be controlled, and thus is permitted to adjust itself freely in response to the heat exchange process as it takes place within the fluidized bed heat exchangers (FBHE).

On the other hand, the control scheme to which the present invention is directed does not suffer from this deficiency, i.e., the inability to control evaporative steam temperature within the fluidized bed heat exchangers (FBHE), by which control schemes of the type described hereinabove have shown to be disadvantageously characterized. To this end, rather than employing a single cyclone with which a fluidized bed heat exchanger (FBHE) is cooperatively associated or two cyclones each having a fluidized bed heat exchanger (FBHE) cooperatively associated therewith, in accordance with the present invention there are provided a multiplicity of cyclones, each acting in parallel with the other two cyclones and each having a fluidized bed heat exchanger (FBHE) cooperatively associated therewith. Moreover, each of the latter fluidized bed heat exchangers (FBHE) is thermally isolated from each of the other fluidized bed heat exchangers (FBHE). Furthermore, each of the latter fluidized bed heat exchangers (FBHE) is dedicated to either superheat steam duty or reheat steam duty or evaporative steam duty. As such, in accordance with the present invention each of these three fluidized bed heat exchangers (FBHE), which are cooperatively associated with an individual one of the aforementioned multiplicity of cyclones, is designed so as to be capable of being controlled by a separate control system. As a consequence of this capability of being controlled by a separate control system, it is thus possible in accordance with the present invention to exercise direct control over not only the temperature within the furnace volume of the circulating fluidized bed steam generator (CFB) but concomitantly to also exercise independent control over the final superheat steam temperature and over the final reheat steam temperature.

Direct control of the temperature within the furnace volume affords improved versatility in the operation of the circulating fluidized bed steam generator (CFB). In particular, it is now possible in accordance with the present invention to satisfy total evaporative steam flow requirements with various fuel particle sizes by shifting evaporative steam duty between the waterwall tubes of the furnace volume and a fluidized bed heat exchanger (FBHE), which has been designed to be dedicated to evaporative steam duty. If the particle size of the fuel is too large then the particles, which have been subjected to combustion within the furnace volume of the circulating fluidized bed steam generator (CFB), are less likely to become entrained in the flue gases that are produced as a result of such combustion. A consequence of this is that less heat is available to be transferred from the flue gases to the waterwall tubes, which define the furnace volume of the circulating fluidized bed steam generator (CFB). Moreover, the effect thereof is that less heat is transferred to the aforementioned waterwall tubes. With less heat being transferred to these waterwall tubes, the temperature of the hot solids, which result from the combustion of fuel and air within the furnace volume of the circulating fluidized bed steam generator (CFB), rises. More evaporative steam is thus required to be produced by the fluidized bed heat exchanger (FBHE), which has been dedicated to do evaporative steam duty, in order to thereby compensate for the fact that less evaporative steam is produced in the waterwall tubes of the furnace volume. An additional effect of the temperature of the hot solids being raised is that by virtue of these hot solids being recirculated to the lower segment of the furnace volume, the temperature within the furnace volume is also raised. In response to this increase in the temperature within the furnace volume, in accordance with the present invention, that control system, which is designed to be operative to control the amount of evaporative steam duty done by the fluidized bed heat exchanger (FBHE) that is dedicated to performing this function, is operative to effect a lowering of the temperature within the furnace volume.

On the other hand, if the particle size of the fuel is too small then the particles, which have been subjected to combustion within the furnace volume of the circulating fluidized bed steam generator (CFB), are more likely to flow to the backpass. The effect of this is that the temperature of the aforesaid hot solids is reduced, with the concomitant effect that the temperature within the furnace volume also is reduced as these hot solids are recirculated to the lower segment of the furnace volume. In response to this decrease in the temperature within the furnace volume, in accordance with the present invention, that control system, which is designed to be operative to control the amount of evaporative steam duty done by the fluidized bed heat exchanger (FBHE) that is dedicated to performing this function, is operative to effect a raising of the temperature within the furnace volume.

In accordance with the present invention, it is also possible therewith to satisfy evaporative steam flow requirements when fuels of different types are being combusted within the circulating fluidized bed steam generator (CFB). As in the case of particles of different sizes, which has been the subject of discussion hereinabove, this is also accomplished by shifting evaporative steam duty between the waterwall tubes of the furnace volume and the fluidized bed heat exchanger (FBHE), which is designed to be dedicated to evaporative steam duty. Different types of fuels contain different amounts of ash. With an increase in ash more heat is transferred to the waterwall tubes of the furnace volume, and thus the temperature of the hot solids, which are produced from the combustion of fuel and air within the furnace volume, is reduced. Moreover, the effect thereof is to also reduce the temperature within the furnace volume as these hot solids are recirculated to the lower segment of the furnace volume. In response to this reduction in the temperature within the furnace volume, in accordance with the present invention, that control system, which is designed to be operative to control the amount of evaporative steam duty done by the fluidized bed heat exchanger (FBHE) that is dedicated to performing this function, is capable of effecting a rise in the temperature within the furnace volume. On the other hand, if there is a decrease in the ash content of the fuel, less heat is transferred from the flue gases to the waterwall tubes of the furnace volume thereby causing the temperature of the aforementioned hot solids to rise. The effect thereof in turn is to cause the temperature within the furnace volume to also rise as these hot solids are recirculated to the lower segment of the furnace volume. In response to this rise in the temperature within the furnace volume, in accordance with the present invention, that control system, which is designed to be operative to control the amount of evaporative steam duty done by the fluidized bed steam generator (FBHE) that is dedicated to performing this function, is capable of effecting a reduction in the temperature within the furnace volume.

A further benefit derivable from the direct control, in accordance with the present invention, of the temperature within the furnace volume is that it is now possible to maintain higher temperatures within the furnace volume at lower operating loads of the circulating fluidized bed steam generator (CFB). As such, there is less likelihood that a need will exist to use expensive auxiliary fuel to supplement the base fuel when the circulating fluidized bed steam generator (CFB) is being operated at lower loads. In addition, yet another benefit derivable therefrom is that the fly ash embodies less carbon whereby the efficiency of the circulating fluidized bed steam generator (CFB) is improved and concomitantly the operating costs of the circulating fluidized bed steam generator (CFB) are reduced. Also, yet still another benefit derivable therefrom is that lower carbon monoxide and volatile organic compounds are present, which facilitates the meeting of emission standards.

Yet still a further benefit to be derived from the direct control, in accordance with the present invention, of the temperature within the furnace volume is that it is possible to effect an optimization of $NO_X$, $SO_X$ and CO emissions with respect to the temperature within the furnace volume. Based upon known relationships between the temperature within the furnace volume and the resulting $NO_X$, $SO_X$ and CO emissions for given fuels, a set point temperature may be chosen for the temperature within the furnace volume. Moreover, the controller through which the direct control of the temperature within the furnace volume is accomplished in accordance with the present invention can be designed to be operative about the aforementioned set point temperature for purposes thereby of enabling the temperature within the furnace volume to be maintained while at the same time enabling emission standards to be met.

Continuing, the capability in accordance with the present invention to be able to exercise independent control over the superheat steam temperature and over the reheat steam temperature renders the need for water spray stations, to which reference has been had hereinbefore, unnecessary. In turn, this means that the water, which would otherwise need to be utilized for the water spray stations, can now be used for purposes of the generation of steam, thus enabling the utilization of the available heat transfer surface within the circulating fluidized bed steam generator (CFB) to be optimized, while still enabling the turbines cooperatively associated with the circulating fluidized bed steam generator (CFB) to be protected from heat excursions occasioned by increases in the temperature of the superheat steam that is supplied thereto from the circulating fluidized bed steam generator (CFB) and/or by increases in the temperature of the reheat steam that is supplied thereto from the circulating fluidized bed steam generator (CFB).

By way of exemplification and not limitation, an additional benefit derivable from the present invention is that there is no increase in the complexity of the control system thereof when the number of fluidized bed heat exchangers (FBHE), which are cooperatively associated with the circulating fluidized bed steam generator (CFB), is increased.

From the foregoing it should thus be readily apparent that it is possible through the utilization of the present invention to accomplish the two objectives described hereinbelow, when the present invention is employed in a circulating fluidized bed steam generator (CFB) that employs a steam cycle encompassing reheat. Namely, in accordance with the present invention it is possible therewith to exercise direct control of the temperature within the furnace volume thereby affording greater versatility insofar as the operation of the circulating fluidized bed steam generator (CFB) is concerned. Secondly, in accordance with the present invention it is possible therewith to exercise independent control over the final superheat steam temperature and over the final reheat steam temperature, thus eliminating the need for the circulating fluidized bed steam generator (CFB) to be provided with water spray stations.

It is, therefore, an object of the present invention to provide a new and improved control scheme, which is particularly suited for employment with large circulating fluidized bed steam generators (CFB).

It is another object of the present invention to provide such a new and improved control scheme, which is particularly suited for employment with large circulating fluidized bed steam generators (CFB), that is characterized in that direct control is capable of being exercised therewith over the temperature within the furnace volume of the circulating fluidized bed steam generator (CFB).

It is still another object of the present invention to provide such a new and improved control scheme, which is particularly suited for employment with large circulating fluidized bed steam generators (CFB), that is characterized by the fact that the circulating fluidized bed steam generator (CFB) is capable of being operated with greater versatility in that the circulating fluidized bed steam generator (CFB) is capable of accommodating fuel of different particles sizes as well as fuels of various types, and is capable of being operated in accordance with various load demands.

Another object of the present invention is to provide such a new and improved control scheme, which is particularly suited for employment with large circulating fluidized bed steam generators (CFB), that is characterized in that it is possible therewith to effect an optimization of $NO_X$, $SO_X$ and CO emissions relative to the temperature within the furnace volume of the circulating fluidized bed steam generator (CFB).

A still another object of the present invention is to provide such a new and improved control scheme, which is particularly suited for employment with large circulating fluidized bed steam generators (CFB), that is characterized in that independent control is capable of being effected therewith over the final superheat steam temperature and over the final reheat steam temperature.

A further object of the present invention is to provide such a new and improved control scheme, which is particularly suited for employment with large circulating fluidized bed steam generators (CFB), that is characterized in that the utilization thereof does not increase the complexity of the control system of the circulating fluidized bed steam generator (CFB).

Yet another object of the present invention is to provide such a new and improved control scheme, which is particularly suited for employment with large circulating fluidized bed steam generators (CFB), that is characterized in that it is possible through the utilization thereof to eliminate the need for expensive water spray stations in the superheat steam portion and in the reheat steam portion of the steam cycle of the circulating fluidized bed steam generator (CFB).

SUMMARY OF THE PRESENT INVENTION

In accordance with the present invention there is provided a circulating fluidized bed steam generator (CFB) embodying therewithin a circulating flow path for the hot solids, which are produced from the combustion of fuel and air within the circulating fluidized bed steam generator (CFB), consisting of a multiplicity of separate and distinct branches thereof, each both emanating from and returning to the furnace volume of the circulating fluidized bed steam generator (CFB).

Further in accordance with the present invention, within each of said multiplicity of separate and distinct branches of the circulation flow path for the hot solids there is provided a fluidized bed heat exchanger (FBHE), which is dedicated to perform heat exchange duty for a separate portion of the thermodynamic steam cycle of the circulating fluidized bed steam generator (CFB).

Still further in accordance with the present invention there is provided a control system, which is cooperatively associated with each of said fluidized bed heat exchangers (FBHE), that is operative to enable direct control to be effected therewith over the temperature within the furnace volume of the circulating fluidized bed steam generator (CFB).

Also in accordance with the present invention said control system, which is cooperatively associated with each of said fluidized bed heat exchangers (FBHE), is in addition operative to enable independent control to be effected therewith over the final superheat steam temperature and over the final reheat steam temperature.

The circulation flow path of the hot solids begins in the lower segment of the furnace volume of the circulating fluidized bed steam generator (CFB) wherein fuel is mixed with sorbent and air and is combusted. Such combustion in turn produces hot combustion gases in which the hot solids that are produced during the aforesaid combustion of the fuel become entrained with the hot combustion gases. As the hot combustion gases with the hot solids entrained therewith rise within the furnace volume of the circulating fluidized bed steam generator (CFB), heat is transferred therefrom to the waterwall tubes, which define the furnace volume of the circulating fluidized bed steam generator (CFB). As a consequence of this heat transfer steam is produced by evaporation within the waterwall tubes of the furnace volume.

Continuing, at the top of the furnace volume the hot gases, now generally referred to as flue gases, with the hot solids still entrained therewithin flow through a multiplicity of separate and distinct ducts arranged in parallel relation one to another. At the exit end of each of these ducts there is provided a cyclone, each such cyclone being operative for the purpose of effecting therewith the mechanical separation from the flue gases of the hot solids entrained therewithin, which are above a predetermined size. From the cyclones the flue gases are directed to a common backpass, with which the circulating fluidized bed steam generator (CFB) is suitably provided, for the purpose of performing an additional portion of the heat transfer duty required by the steam cycle of the circulating fluidized bed steam generator (CFB). On the other hand, the hot solids after being separated from the flue gases within the cyclones under the influence of gravity fall through the cyclone in which these hot solids were separated from the flue gases. Downstream of each cyclone there is suitably provided a stand pipe followed by a seal pot into which a portion of the hot solids, which have been separated from the flue gases in the cyclones, flow into and through. These hot solids after flowing through the seal pot are caused to be reintroduced into the lower segment of the furnace volume wherein these recirculated hot solids are once again subjected to the combustion process that takes place in the circulating fluidized bed steam generator (CFB).

On the other hand, the remaining portion of the hot solids, which have been separated from the flue gases in the cyclones, before reaching the particular seal pot that is cooperatively associated with the particular cyclone in which such hot solids were separated from the flue gases, are diverted to the particular fluidized bed steam generator (FBHE), which is cooperatively associated with the particular cyclone in which such hot solids were separated from the flue gases. During their passage through a fluidized bed heat exchanger (FBHE), a heat transfer occurs whereby such hot solids are cooler when they exit from the fluidized bed heat exchanger (FBHE) than they are when they enter the fluidized bed heat exchanger (FBHE). After flowing through the aforereferenced fluidized bed heat exchanger (FBHE), such hot solids, i.e., the remaining portion of the hot solids, are caused to be reintroduced into the lower segment of the furnace volume wherein these recirculated hot solids are once again subjected to the combustion process that takes place within the circulating fluidized bed steam generator (CFB). Note is made here of the fact that because of the heat transfer to which the hot solids are subjected during their passage through a fluidized bed heat exchanger (FBHE), the hot solids that are recirculated to the lower segment of the furnace volume from a fluidized bed heat exchanger (FBHE) are cooler than are the hot solids that are recirculated to the lower segment of the furnace volume from a seal pot.

Further, note is also made herein of the fact that each of the fluidized bed heat exchangers (FBHE) possesses a single input/single output capability for the hot solids and a multiple input/multiple output capability for the relatively cooler steam, which also is made to flow through the fluidized bed heat exchangers (FBHE). It is between this steam and the hot solids that the heat transfer to which reference has been had hereinabove takes place. Continuing, there is no mixing of the media within a particular fluidized bed heat exchanger (FBHE) in that the steam originates from a common inlet header and is fed to a common outlet header, and during the passage thereof through the fluidized bed heat exchanger (FBHE) is confined within a bundle of tubes, with the latter bundle of tubes being immersed in the hot solids, which have been the subject of discussion hereinbefore.

In accordance with the present invention, each fluidized bed heat exchanger (FBHE) is dedicated to perform heat transfer duty for a specific segment of the steam cycle of the circulating fluidized bed steam generator (CFB). Namely, one is dedicated to do heat transfer duty relative to superheat steam, another one is dedicated to do heat transfer duty relative to reheat steam, and yet another one is dedicated to do heat transfer duty relative to evaporative steam.

Furthermore, in accordance with the present invention, the mass flow rate of hot solids into each fluidized bed heat exchanger (FBHE) is separately controlled. In this regard, the fluidized bed heat exchanger (FBHE), which is dedicated to superheat steam, and the fluidized bed heat exchanger (FBHE), which is dedicated to reheat steam, are each controlled in the same manner. That is, the temperature of the steam, be it superheat steam or reheat steam, exiting from the fluidized bed heat exchanger (FBHE) is sensed, and a signal representative of the sensed temperature is fed back to a controller. Depending upon whether the sensed steam temperature is above or below a preestablished set point temperature value, the controller will cause a valve, which is cooperatively associated therewith, either to more fully open or to more fully close, which in turn is effective to regulate the mass flow rate of hot solids into the particular fluidized bed heat exchanger (FBHE), from which the temperature of the steam exiting therefrom has been sensed, so as to thereby cause the sensed steam temperature to return to the set point temperature value, which has been preestablished therefor. Since the fluidized bed heat exchangers (FBHE) that are dedicated to heat transfer duty for the superheat steam segment and for the reheat steam segment of the steam cycle of the circulating fluidized bed steam generator (CFB) are each separate and distinct one from another, as is the control that is exercised thereover, it is possible in accordance with the present invention to effect independent control over the final superheat steam temperature as well as independent control over the final reheat steam temperature.

In contrast to the preceding, the manner in which control is exercised over the fluidized bed heat exchanger (FBHE) that is dedicated to heat transfer duty for the evaporative steam segment of the steam cycle of the circulating fluidized bed steam generator (CFB) is accomplished in the following fashion. The temperature within the furnace volume of the circulating fluidized bed steam generator (CFB) is sensed, and a signal representative of the sensed temperature is fed back to a controller, which is separate and distinct from the controllers to which reference has been had hereinbefore. Depending upon whether the sensed furnace volume temperature is above or below a preestablished set point temperature value, this controller like the controllers to which reference has been had hereinbefore, causes a valve, which is cooperatively associated therewith, either to more fully open or to more fully close, which in turn is effective to regulate the mass flow rate of hot solids into the particular fluidized bed steam generator (FBHE) that is dedicated to evaporative steam duty in an effort to thereby cause the sensed furnace volume temperature to return to the set point temperature value, which has been preestablished therefor.

DESCRIPTION OF THE PREFERRED EMBODIMENT

Figure 1:
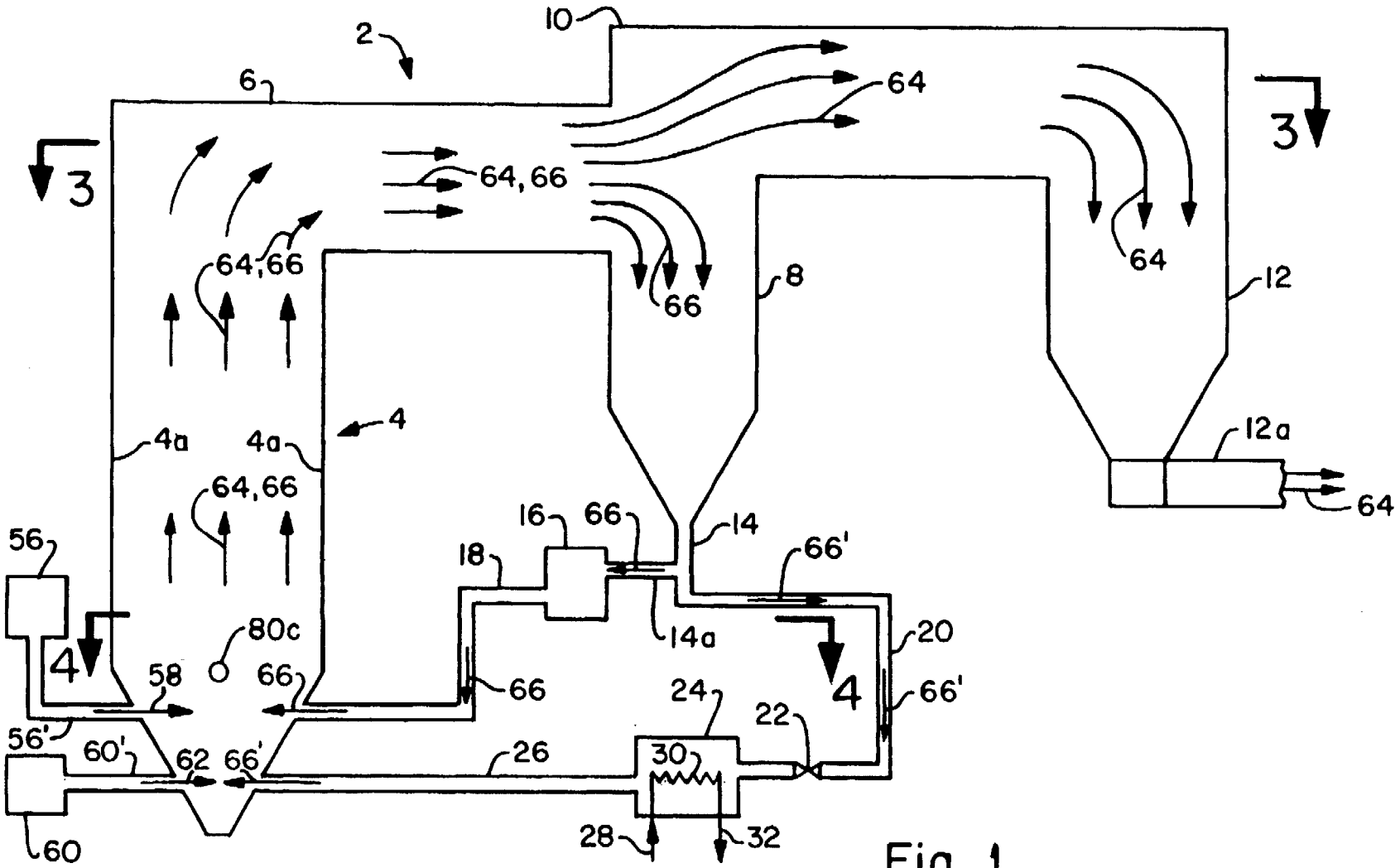
FIG. 1 is a schematic representation in the nature of a side elevational view of a circulating fluidized bed steam generator (CFB) including a furnace volume, a cyclone section, a backpass section, a seal pot section and a fluidized bed heat exchanger (FBHE) section, constructed in accordance with the present invention.

Referring now to FIG. 1 of the drawing, there is depicted therein a circulating fluidized bed steam generator (CFB), generally designated by the reference numeral 2. As illustrated in FIG. 1, the circulating fluidized bed steam generator 2 includes a furnace volume, denoted therein by the reference numeral 4, the latter being defined by waterwall tubes, denoted therein by the reference numeral 4*a*; a first section of ductwork, denoted therein by the reference numeral 6; a cyclone section, denoted therein by the reference numeral 8; a second section of ductwork, denoted therein by the reference numeral 10; a backpass volume, denoted therein by the reference numeral 12, from which further ductwork, denoted therein by the reference numeral 12*a*, extends.

Figure 3:
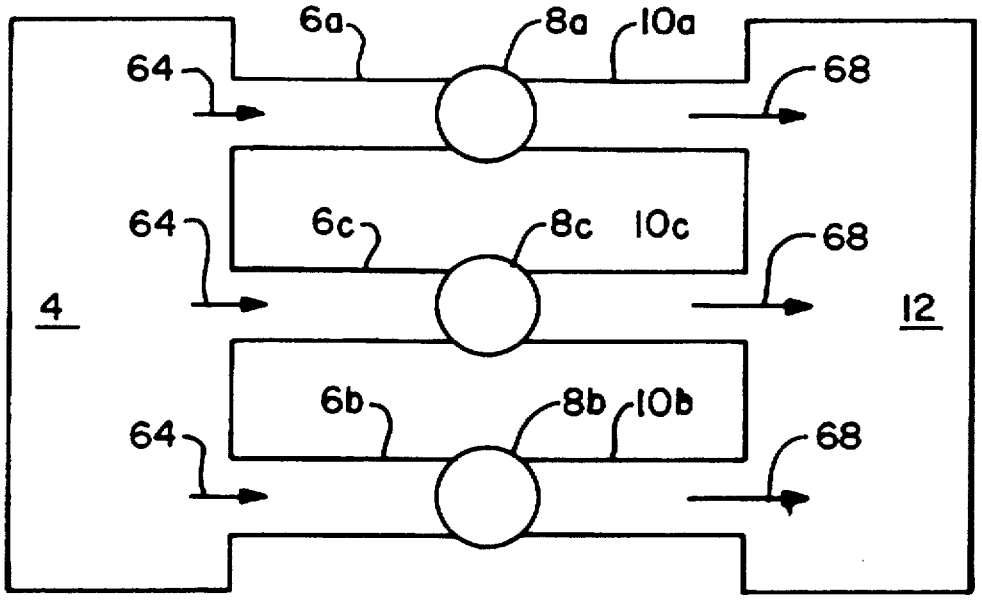
FIG. 3 is a plan view of the circulating fluidized bed steam generator (CFB) illustrated in FIG. 1, depicting the furnace volume, the cyclone section, and the backpass section thereof.

Turning next briefly to FIG. 3 of the drawing, there is illustrated therein a plan view of the circulating fluidized bed steam generator (CFB) 2. As will be best understood from a reference to FIG. 3, the cyclone section 8 is comprised of three cyclones, denoted therein by the reference numerals 8*a*, 8*b*, 8*c*, respectively. In addition, it can be seen from a reference to FIG. 3 that the first section of ductwork 6 is comprised of three ducts, denoted therein by the reference numerals 6*a*, 6*b*, 6*c*, respectively. Moreover, as can be seen from a reference to FIG. 3, each of the ducts 6*a*, 6*b*, 6*c*, respectively, extends in parallel relation with one another and each has one end thereof connected in fluid flow relation with the upper segment of the furnace volume 4 while the other end thereof is connected in fluid flow relation with a corresponding one of the three cyclones 8*a*, 8*b*, 8*c*. Finally, it will also be seen from a reference to FIG. 3 that the second section of ductwork 10 is comprised of three ducts, denoted therein by the reference numerals 10*a*, 10*b*, 10*c*, respectively. In a fashion similar to the ducts 6*a*, 6*b*, 6*c*, each of the ducts 10*a*, 10*b*, 10*c* extends in parallel relation with one another but rather than having one end thereof connected in fluid flow relation with the upper segment of the furnace volume 4, each of the ducts 10*a*, 10*b*, 10*c* has one end thereof connected in fluid flow relation with the upper segment of the backpass volume 12 while the other end thereof is connected in fluid flow relation with a corresponding one of the three cyclones 8*a*, 8*b*, 8*c*.

Returning now to a consideration of FIG. 1 of the drawings, it will be understood from a reference thereto that the lower segment of the cyclone section 8 is connected in fluid flow relation with the lower segment of the furnace volume 4 through a fluid flow system consisting, in accordance with the illustration thereof in FIG. 1 of a standpipe, denoted therein by the reference numerals 14 and 14*a*; a seal pot, denoted therein by the reference numeral 16; a hot solids inlet, denoted therein by the reference numeral 18; a fluidized bed heat exchanger (FBHE) inlet, denoted therein by the reference numeral 20; an ash control valve, denoted therein by the reference numeral 22; a fluidized bed heat exchanger (FBHE), denoted therein by the reference numeral 24; and a fluidized bed heat exchanger (FBHE) outlet, denoted therein by the reference numeral 26. For purposes of the discussion that follows hereinafter, the first section of the ductwork 6, the cyclone section 8 and the fluid flow system 14, 14*a*, 16, 18, 20, 22, 24, 26 and 28 will be referred to as a hot solids circulation path, denoted by the reference numerals 64, 66, 66', 64. Further, it is to be understood that the fluid flow system 14, 14*a*, 16, 18, 20, 22, 24, 26 and 28 is typical of the fluid flow system, which is cooperatively associated with each of the cyclones 8*a*, 8*b*, 8*c*. As such, it is deemed to be sufficient to describe herein only one such fluid flow system 14, 14*a*, 16, 18, 20, 22, 24, 26 and 28 with the understanding that the fluid flow systems for the other two of the three cyclones 8*a*, 8*b*, 8*c* are identical in terms of the construction thereof and the mode of operation thereof as the one that has been described herein. Finally, it can be seen from a reference to FIG. 1 of the drawing that the furnace volume 4 is in communication with a source, denoted therein by the reference numeral 56, of fuel and sorbent through a supply line, denoted therein by the reference numeral 56', as well as with a source, denoted therein by the reference numeral 60, of air through a supply line, denoted therein by the reference numeral 60'.

With regard to FIG. 1 of the drawing, it will be understood from reference thereto that in the lower segment of the furnace volume 4 a mixture of fuel and sorbent, denoted therein by the reference numeral 58, is mixed for purposes of the combustion thereof with air, denoted therein by the reference numeral 62. In known fashion, from this combustion hot combustion gases, denoted therein by the reference numeral 64, are produced and hot solids, denoted therein by the reference numeral 66, are entrained in the hot combustion gases 64. These hot combustion gases 64 with the hot solids 66 entrained therewith rise within the furnace volume 4 whereupon at the top of the furnace volume 4 the hot combustion gases 64 with the hot solids 66 entrained therewith are made to flow through the ducts 6*a*, 6*b*, 6*c*, which extend in parallel relation with each other, to a corresponding one of the cyclones 8*a*, 8*b*, 8*c*. Within each of the cyclones 8*a*, 8*b*, 8*c* the hot solids 66 that are made to flow thereto, which are above a predetermined size, are separated from the hot combustion gases 64 in which they are entrained. The separated hot solids 66 which contain unburned fuel, flyash and sorbent flow through the corresponding one of the cyclones 8*a*, 8*b*, 8*c*. From the cyclones 8*a*, 8*b*, 8*c* the hot solids 66 are discharged under the influence of gravity into a corresponding stand pipe 14 and 14*a*, from whence a portion of the hot solids 66 flow through the stand pipe 14*a* to and through a corresponding seal pot 16. Thereafter, from the seal pot 16, this portion of the hot solids 66 is reintroduced by means of a corresponding hot solids inlet 18 into the lower segment of the furnace volume 4 whereupon this portion of the hot solids 66 are once again subjected to the combustion process that takes place in the circulating fluidized bed steam generator (CFB) 2. The remainder of the hot solids 66, which are above a predetermined size, are diverted from the corresponding one of the three cyclones 8*a*, 8*b*, 8*c* to a corresponding fluidized bed heat exchanger (FBHE) 24 by way of a corresponding heat exchanger inlet 20 and thence to the lower segment of the furnace volume 4 via a corresponding heat exchanger outlet 26.

Continuing, on the other hand the hot combustion gases 64 leaving the cyclones 8*a*, 8*b*, 8*c*, hereinafter referred to as flue gases, are directed from the cyclones 8*a*, 8*b*, 8*c* to the backpass volume 12 via the parallelly extending ducts 10*a*, 10*b*, 10*c*, where additional heat transfer duty is performed therewith as will be described more fully hereinafter. From the backpass volume 12 the flue gases 64 exit through the ductwork 12*a* to a particulate removal system (not shown in the interest of maintaining clarity of illustration in the drawings) whereupon the flue gases 64 are discharged to the atmosphere through a stack (not shown in the interest of maintaining clarity of illustration in the drawings).

Figure 2:
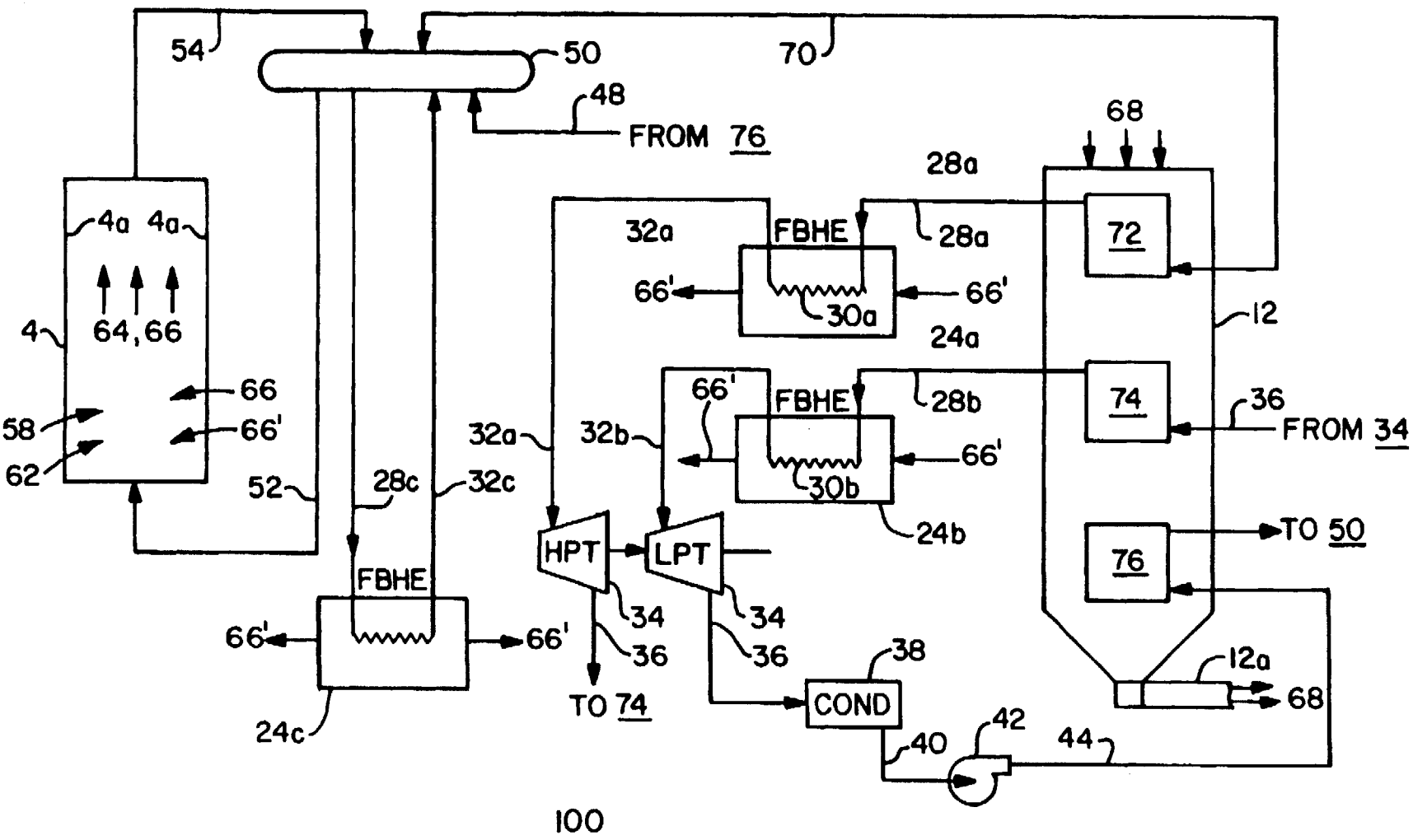
FIG. 2 is a simplified schematic representation of the fluid circuitry of the thermodynamic steam cycle employed with the circulating fluidized bed steam generator illustrated in FIG. 1.

For purposes of better understanding how the combustion process occurring within the furnace volume 4 is integrated with the hot solids circulation path 64, 66, 66', 64, and the flow path of the flue gases 64, and with the thermodynamic steam cycle, denoted by the reference numeral 100, of the circulating fluidized bed steam generator (CFB) 2, reference will now be had to FIG. 2 of the drawings. As will be understood with reference to FIG. 2, the thermodynamic steam cycle 100 includes a first evaporative steam loop 50, 52, 4*a*, 54, 50, which is designed to act in parallel with a second evaporative steam loop 50, 28*c*, 30*c*, 32, 50. Finally, it will be understood with reference to FIG. 2 that the thermodynamic steam cycle 100 also includes a superheat steam segment 50, 70, 72, 28*a*, 30*a*, 32*a*, 34, 36, a reheat steam segment 74, 28*b*, 30*b*, 32*b*, 34, 36, and an economizer segment 38, 40 42, 44, 76, 50.

The first evaporative steam loop 50, 52, 4*a*, 54, 50 becomes operative as a function of the combustion process, which takes place within the furnace volume 4. As has been noted herein previously, as the hot combustion gases 64 with the hot solids 66 entrained therewith rise within the furnace volume 4 heat is transferred therefrom to the waterwall tubes 4*a*, which serve to define the furnace volume 4. As a consequence thereof, the saturated water, denoted in FIG. 2 by the reference numeral 52, which enters the waterwall tubes 4*a* from the steam drum, denoted in FIG. 2 by the reference numeral 50, is evaporatively changed to a mixture, denoted in FIG. 2 by the reference numeral 54, of saturated water and saturated steam. This mixture 54 then flows to the steam drum 50 for separation wherein saturated water 52 is once again made to flow to the waterwall tubes 4*a* while the saturated steam, denoted in FIG. 2 by the reference numeral 72, is made to flow to the superheat surface, denoted in FIG. 2 by the reference numeral 72, which has been suitably provided in the backpass volume 12 and to which further reference will be had hereinafter.

The second evaporative steam loop 50, 28*c*, 30*c*, 32*c*, 50 becomes operative as a result of the heat transfer process, which takes place within the fluidized bed heat exchanger (FBHE) 24*c*. To this end, saturated water, denoted in FIG. 2 by the reference numeral 28*c*, which originates from the steam drum 50, enters the fluidized bed heat exchanger (FBHE) 24*c*. In the course of the passage thereof through the fluidized bed heat exchanger (FBHE) 24*c*, the saturated water 28*c* is converted to a mixture, denoted in FIG. 2 by the reference numeral 32*c*, of saturated steam and saturated water as a result of the heat transfer, which occurs as the hot solids, denoted in FIG. 2 by the reference numeral 66', flow through the fluidized bed heat exchanger (FBHE) 24*c*. The mixture 32*c* of saturated steam and saturated water then flows to the steam drum 50 for separation wherein the saturated water 28*c* is once again made to flow to the fluidized bed heat exchanger (FBHE) 24*c*, while the saturated steam, denoted in FIG. 2 by the reference numeral 70 is made to flow to the superheater, denoted in FIG. 2 by the reference numeral 72, to which further reference will be had hereinafter.

Continuing, within the superheater 72 a transfer of heat takes place between the relatively cool saturated steam 70 and the relatively hot flue gases 68 to which reference has been made hereinbefore. The steam, denoted in FIG. 2 by the reference numeral 28*a*, exiting from the superheater 72 is now in a superheated state. From the superheater 72, the steam 28*a* is made to flow to the fluidized bed heat exchanger (FBHE), denoted in FIG. 2 by the reference numeral 24*a*, wherein the steam 28*a* is further superheated by a transfer of heat thereto from the relatively hot solids 66' that circulate through the fluidized bed heat exchanger (FBHE) 24*a*. Upon exiting from the fluidized bed heat exchanger (FBHE) 24*a*, the steam, denoted in FIG. 2 by the reference numeral 32*a*, is now in a highly superheated state and is made to flow to the high pressure turbine (HPT), denoted in FIG. 2 by the reference numeral 34.

After expansion within the high pressure turbine (HPT) 34 the still superheated steam, denoted in FIG. 2 by the reference numeral 36, is made to flow to the reheater, denoted in FIG. 2 by the reference numeral 74. Within the reheater 74 there takes place a transfer of heat to the relatively cool superheated steam 36 from the still relatively hot flue gases 68, to which reference has been had herein previously. The steam, denoted in FIG. 2 by the reference numeral 28*b*, exiting from the reheater 74 is still in a superheated state. From the reheater 74 the steam 28*b* is made to flow to the fluidized bed heat exchanger (FBHE), denoted in FIG. 2 by the reference numeral 24*b*, wherein the steam 28*b* is further superheated by a transfer of heat to the relatively cool superheated steam 28*b* from the relatively hot solids 66', which circulate through the fluidized bed heat exchanger (FBHE) 24*b*. Upon exiting from the fluidized bed heat exchanger 24b, the steam, denoted in FIG. 2 by the reference numeral 32b, is again in a highly superheated state and is made to flow to the low pressure turbine (LPT), which is denoted in FIG. 2 also by the reference numeral 34.

After further expansion within the low pressure turbine (LPT) 34, the now saturated steam, denoted in FIG. 2 by the reference numeral 36, flows to a condenser, denoted in FIG. 2 by the reference numeral 38, wherein the saturated steam 36 is converted to water, denoted in FIG. 2 by the reference numeral 40. The water 40 is then made to flow by means of a pump, denoted in FIG. 2 by the reference numeral 42, to the economizer, denoted in FIG. 2 by the reference numeral 76. Within the economizer 76, a transfer of heat takes place from the still relatively hot flue gases 68, to which reference has been made herein previously, to the relatively cool water, denoted in FIG. 2 by the reference numeral 44. Upon exiting from the economizer 76, the water, denoted in FIG. 2 by the reference numeral 48, is in a saturated state and is made to flow to the steam drum 50. The preceding completes the description herein of the steam cycle 100 of the circulating fluidized bed steam generator (CFB) 2.

The steam produced within the aforedescribed steam cycle 100 of the circulating fluidized bed steam generator (CFB) 2 is operative to provide in known fashion the motive power, which is required to drive the high pressure turbine (HPT) 34 as well as the low pressure turbine (LPT) 34. The high pressure turbine (HPT) 34 and the low pressure turbine (LPT) 34 in turn are cooperatively associated with a generator (not shown in the interest of maintaining clarity of illustration in the drawing), which is operative to produce electricity in a conventional manner.

Figure 4:
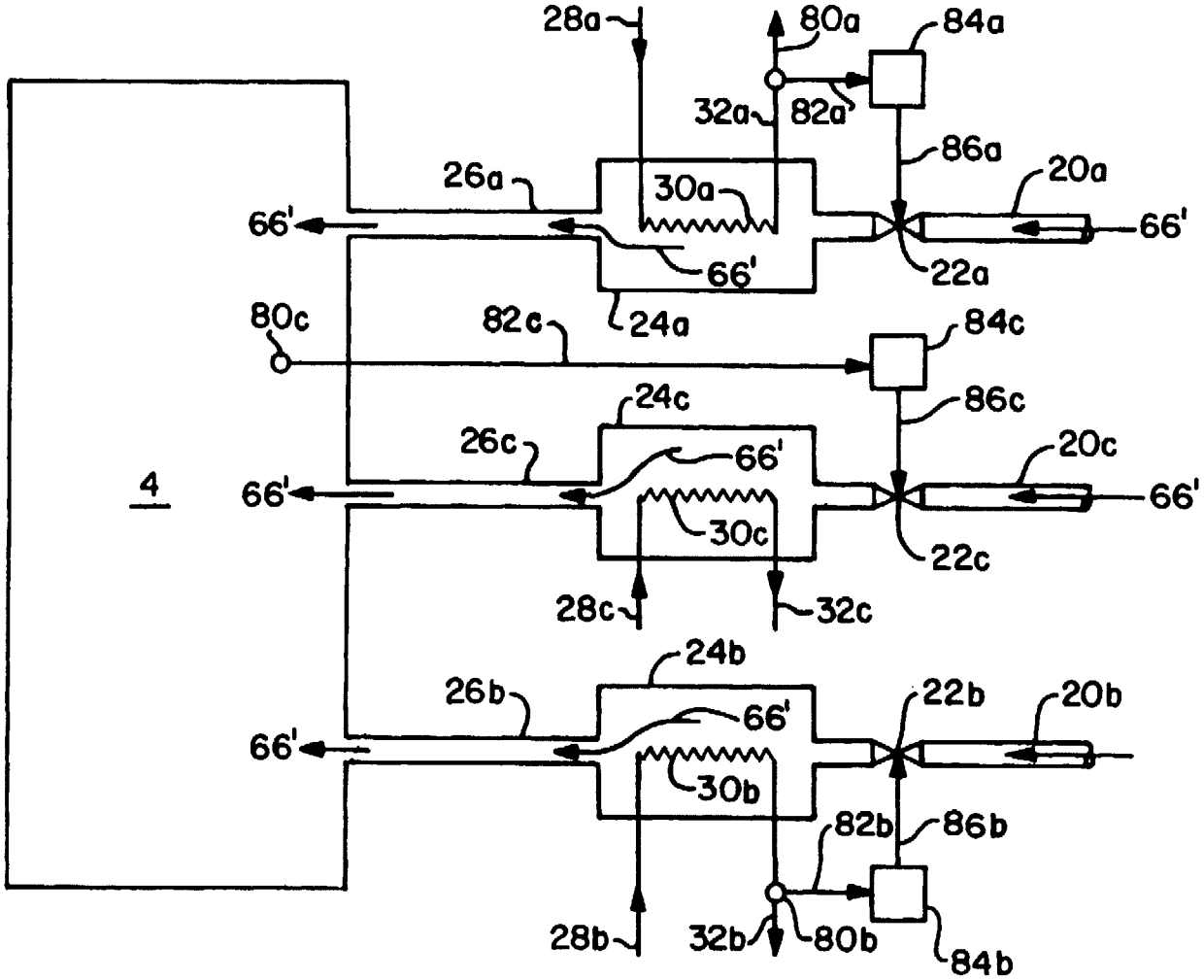
FIG. 4 is a sectional plan view of the circulating fluidized bed steam generator (CFB) illustrated in FIG. 1, depicting the furnace volume, the fluidized bed heat exchangers (FBHE) thereof and the attendant control system by which control is effected over the aforementioned fluidized bed heat exchangers (FBHE).

Reference will next be had herein to FIG. 4 of the drawings wherein there is depicted a sectional plan view of the circulating fluidized bed steam generator (CFB) 2 and which is illustrated with the three fluidized bed heat exchangers (FBHE) 24a, 24b, 24c that are cooperatively associated therewith. Each of the three fluidized bed heat exchangers (FBHE) 24a, 24b, 24c is separately connected in fluid flow relation with the furnace volume 4 of the circulating fluidized bed steam generator (CFB) 2. It will also be readily understood from a reference to FIG. 4 that hot solids 66' circulate through each of the three fluidized bed heat exchangers (FBHE) 24a, 24b, 24c. As set forth herein previously in connection with the description of FIG. 1 of the drawings the heat exchanger inlet 20 is operative to divert the hot solids 66' from the main flow of hot solids 66.

Further, it will also be understood with reference to FIG. 4 that within each of the fluidized bed heat exchangers (FBHE) 24a, 24b, 24c, the hot solids 66' circulate in thermal contact with the heat transfer surfaces 30a, 30b, 30c of the superheat steam segment 50, 70, 72, 28a, 30a, 32a, 34, 36, of the reheat steam segment 74, 28b, 30b, 32b, 34, 36, and of the evaporative steam loop 50, 28c, 30c, 32c, 50, respectively, of the steam cycle 100 of the circulating fluidized bed steam generator (CFB) 2. Through the aforementioned thermal contact, heat transfer is effected from the hot solids 66' to the working fluid of the aforedescribed steam cycle 100 of the circulating fluidized bed heat exchanger (CFB) 2. Thus, it is because of this transfer of heat that the temperature of the hot solids 66' exiting from the fluidized bed heat exchangers (FBHE) 24a, 24b, 24c is less than the temperature of the hot solids 66' entering the fluidized bed heat exchangers (FBHE) 24a, 24b, 24c.

With further reference to FIG. 4 of the drawings, it will be understood with reference thereto that the mass flow rate of the hot solids 66', which are diverted into each of the fluidized bed heat exchangers (FBHE) 24a, 24b, 24c, is regulated by a separate and distinct control system. To this end, each of these separate and distinct control systems is comprised of a temperature sensor, denoted in FIG. 4 by the reference numerals 80a, 80b, 80c, respectively, a temperature signal, denoted in FIG. 4 by the reference numerals 82a, 82b, 82c, respectively, a controller, denoted in FIG. 4 by the reference numerals 84a, 84b, 84c, and is operative to generate a command signal, denoted in FIG. 4 by the reference numerals 86a, 86b, 86c, respectively. The aforereferenced separate and distinct control systems, which regulate the mass flow rate of hot solids 66' into the fluidized bed heat exchanges (FBHE) 24a and 24b that are dedicated to the superheat steam segment 50, 70, 72, 28a, 30a, 32a, 34, 36 and the reheat steam segment 74, 28b, 30b, 32b, 34, 36, respectively, of the steam cycle 100 of the circulating fluidized bed steam generator (CFB) 2 are identical in terms of the nature of the construction thereof as well as in terms of the mode of operation thereof. As such it is deemed sufficient for purposes of acquiring an understanding thereof to describe hereinafter the nature of the construction and the mode of operation of only one of these two separate and distinct control systems, with the understanding that the other one is identical thereto.

Thus, continuing, each of these two separate and distinct control systems includes a temperature sensor 80a, 80b, respectively, so located as to be operative to sense the temperature of the steam 32a, 32b, respectively, exiting from the fluidized bed heat exchangers (FBHE) 24a, 24b, respectively. Each of the temperature sensors 80a, 80b, respectively, is operative to produce a temperature signal 82a, 82b, respectively, representative of the steam temperature sensed thereby. The temperature signal 82a, 82b, respectively, is fed as an input to a controller 84a, 84b, respectively, which operatively responds in a prescribed manner to the receipt thereby of the temperature signal 82a, 82b, respectively. Namely, if the temperature of the outlet steam 32a, 32b, respectively, exiting from the fluidized bed heat exchanger (FBHE) 24a, 24b, respectively, rises above a preestablished set point temperature value, a command signal 86a, 86b, respectively, originating from the controller 84a, 84b, respectively, is directed to a control valve 22a, 22b, respectively. This signal 86a, 86b, respectively, causes the control valve 22a, 22b, respectively, to more fully close thus reducing the mass flow rate of hot solids 66' into the fluidized bed heat exchangers 24a, 24b, respectively, thereby effecting the return of the outlet steam temperature 32a, 32b, respectively, to the desired set point temperature value. Conversely, if the temperature of the outlet steam 32a, 32b, respectively, falls below the preestablished set point temperature value, the command signal 86a, 86b, respectively, causes the control valve 22a, 22b, respectively, to more fully open thus increasing the mass flow rate of hot solids 66' into the fluidized bed heat exchanger (FBHE) 24a, 24b, respectively, thereby effecting the return of the temperature of the outlet steam 32a, 32b, respectively, to the preestablished set point temperature value.

With further reference to FIG. 4 of the drawing, it is respectfully submitted that it will be readily understood therefrom that the mass flow rate of hot solids 66' is regulated, by means of the remaining one of the separate and distinct control systems, into the fluidized bed heat exchanger (FBHE) 24a, the latter being dedicated to the evaporative steam loop 50, 28c, 30c, 32c, 50. The aforereferenced separate and distinct control system includes a temperature sensor, denoted in FIG. 4 by the reference numeral 80c, so located as to be operative to sense the temperature of the furnace volume 4. The temperature sensor 80c is operative to produce a temperature signal, denoted in FIG. 4 of the drawing by the reference numeral 82c, representative of the temperature of the furnace volume 4. The temperature signal 82c is fed from the temperature sensor 80c as an input to a controller, denoted in FIG. 4 by the reference numeral 84c, which responds to the receipt thereby of the temperature 82c in a prescribed manner. Namely, if the temperature of the furnace volume 4 rises above a preestablished set point temperature value, a command signal, denoted in FIG. 4 by the reference numeral 86c, originating from the controller 84c is directed to a control valve, denoted in FIG. 4 by the reference numeral 22c. This signal 86c causes the control valve 22c to more fully open thus increasing the mass flow rate of hot solids 66' into the fluidized bed heat exchanger (FBHE) 24c, and therefrom into the furnace volume 4, thereby effecting the return of the temperature of the furnace volume 4 to the desired set point temperature value. Conversely, if the temperature of the furnace volume falls below the preestablished set point temperature value, the command signal 86c causes the control valve 22c to more fully close thus decreasing the mass flow rate of the hot solids 66' into the fluidized bed heat exchanger (FBHE) 24c, and therefrom into the furnace volume 4, thereby effecting the return of the temperature of the furnace volume 4 to the desired set point temperature value.

From the description that has been set forth hereinabove of the steam cycle 100 as shown in FIG. 2 of the drawings of the circulating fluidized bed steam generator (CFB) 2, of the separate and distinct control systems as shown in FIG. 4 of the drawings, and of the hot solids circulation path 64, 6, 66', 64 as shown in FIGS. 1 and 4 of the drawings, it can thus be readily understood that the fluidized bed heat exchangers (FBHE) 24a, 24b, 24c are thermally isolated from one another and are each separately and distinctly controlled, and that the fluidized bed heat exchanger (FBHE) 24a is dedicated to steam cycle duty with the superheat steam segment 70, 72, 28a, 30a, 32a, 34, 36 of the steam cycle 100, that the fluidized bed heat exchanger (FBHE) 24b is dedicated to the reheat steam segment 74, 28b, 30b, 32b, 34, 36 of the steam cycle 100, and that the fluidized bed heat exchanger (FBHE) 24c is dedicated to the evaporative steam loop 50, 28c, 30c, 32c, 50 of the steam cycle 100.

Thus, in accordance with the present invention there has been provided a new and improved control scheme, which is particularly suited for employment with large circulating fluidized bed steam generators (CFB). Besides, there has been provided in accord with the present invention such a new and improved control scheme, which is particularly suited for employment with large circulating fluidized bed heat exchangers (CFB) and which is characterized in that direct control is capable of being exercised therewith over the temperature within the furnace volume of the circulating fluidized bed steam generator (CFB). Moreover, in accordance with the present invention there has been provided such a new and improved control scheme, which is particularly suited for employment with large circulating fluidized bed steam generators (CFB) and which is characterized by the fact that the circulating fluidized bed steam generator (CFB) is capable of being operated with greater versatility in that the circulating fluidized bed steam generator (CFB) is capable of accommodating fuel of different particle sizes as well as fuels of various types, and is capable of being operated in accordance with various load demands. Also, there has been provided in accord with the present invention such a new and improved control scheme, which is particularly suited for employment with large circulating fluidized bed steam generators (CFB) and which is characterized in that it is possible therewith to effect an optimization of $NO_X$, $SO_X$ and CO emissions relative to the temperature within the furnace volume of the circulating fluidized bed steam generator (CFB). Further, in accordance with the present invention there has been provided such a new and improved control scheme, which is particularly suited for employment with large circulating fluidized bed steam generators (CFB) and which is characterized in that independent control is capable of being effected therewith over the final superheat steam temperature and over the final reheat steam temperature. Penultimately, there has been provided in accord with the present invention such a new and improved control scheme, which is particularly suited for employment with large circulating fluidized bed steam generators (CFB) and which is characterized in that the utilization thereof does not increase the complexity of the control system of the circulating fluidized bed steam generator (CFB). Finally, in accordance with the present invention there has been provided such a new and improved control scheme, which is particularly suited for employment with large circulating fluidized bed steam generators (CFB) and which is characterized in that it is possible through the utilization thereof to eliminate the need for expensive water spray stations in the superheat steam segment as well as in the reheat steam segment of the steam cycle of the circulating fluidized bed steam generator (CFB).

While one embodiment of my invention has been shown, it will be appreciated that modifications thereof, some of which have been alluded to hereinabove, may still be readily made thereto by those skilled in the art. I, therefore, intend by the appended claims to cover the modifications alluded to herein as well as all the other modifications which fall within the true spirit and scope of my invention.

What is claimed is:

1. In a circulating fluidized bed steam generator including a furnace volume, first feed means for introducing fuel and sorbent into the furnace volume, second feed means for introducing air into the furnace volume for purposes of effecting therewith the combustion of the fuel that is introduced into the furnace volume by the first feed means thereby causing flue gases and hot solids to be generated as a consequence of such combustion with the hot solids becoming entrained in the flue gases, a plurality of separator means each being operative to effect therewithin the separation of hot solids above a predetermined size from the flue gases received thereby, a backpass volume embodying at least superheat heat transfer surface, a plurality of heat exchange means having fluid circulating therethrough, a plurality of first conduit means each connecting the furnace volume in fluid flow relation with a corresponding one of the plurality of separator means so as to be operative to transport the flue gases with the hot solids entrained in the flue gases from the furnace volume to a corresponding one of the plurality of separator means, and a plurality of second conduit means each connecting a corresponding one of the plurality of separator means in fluid flow relation with a corresponding one of the plurality of heat exchange means so as to be operative to transport the hot solids above a predetermined size that are separated from the flue gases from a corresponding one of the separator means to a corresponding one of the plurality of heat exchange means for circulation therethrough and each connecting a corresponding one of the heat exchange means in fluid flow relation with the furnace volume so as to be operative to transport the hot solids after the circulation thereof through a corresponding one of the plurality of heat exchange means to the furnace volume for reinjection thereinto, the improvement of a control system for effecting therewith direct control over the temperature of the furnace volume and for also effecting therewith independent control over at least superheat steam temperature, said control system comprising:

a. a first valve means located upstream of a first one of the plurality of heat exchange means so as to be operative to control the mass flow rate of hot solids to said first one of the plurality of heat exchange means;

b. a first temperature sensor means operative for sensing the temperature of the furnace volume, said first temperature sensor means being operative to produce a temperature signal representative of the temperature of the furnace volume sensed by said first temperature sensor means;

c. a first controller means connected in circuit relation with said first temperature sensor means and with the furnace volume, said first controller means being operative to produce a command signal in response to the receipt thereby of the temperature signal produced by said first temperature sensor means when the temperature signal received thereby is representative of other than a predetermined set point temperature value for the furnace volume, said first controller means further being operative to provide to said first valve means the command signal produced thereby so as to thereby cause said first valve means to regulate the mass flow rate of hot solids to said one of the plurality of heat exchange means in order to thereby effect the return of the temperature of the furnace volume to the predetermined set point temperature value for the furnace volume;

d. a second valve means located upstream of a second one of the plurality of heat exchange means so as to be operative to control the mass flow rate of hot solids to said second one of the plurality of heat exchange means;

e. a second temperature sensor means operative for sensing the temperature of the fluid exiting from said second one of the plurality of heat exchange means, said second temperature sensor means further being operative to produce a temperature signal representative of the temperature of the fluid sensed by said second temperature sensor means; and f. a second controller means connected in circuit relation with said second temperature sensor means and said second one of the plurality of heat exchange means, said second controller means being operative to produce a command signal in response to the receipt thereby of the temperature signal produced by said second temperature sensor means when the temperature signal received thereby is representative of other than a predetermined set point temperature value for the fluid exiting from said second one of the plurality of heat exchange means, said second controller means further being operative to provide to said second valve means the command signal produced thereby so as to thereby cause said second valve means to regulate the mass flow rate of hot solids to said second one of the plurality of heat exchange means in order to thereby effect the return of the temperature of the fluid exiting from said second one of the plurality of heat exchange means to the predetermined set point temperature value for the fluid exiting from said second one of the plurality of heat exchange means.

2. In a circulating fluidized bed steam generator, the control system as set forth in claim 1 wherein the backpass volume also includes reheat heat transfer surface and wherein said control system further comprises:

a. a third valve means located upstream of a third one of the plurality of heat exchange means so as to be operative to control the mass flow rate of hot solids to said third one of the plurality of heat exchange means;

b. a third temperature sensor means operative for sensing the temperature of the fluid exiting from said third one of the plurality of heat exchange means, said third temperature sensor means further being operative to produce a temperature signal representative of the temperature of the fluid sensed by said third temperature sensor means; and c. a third controller means connected in circuit relation with said third temperature sensor means and said third one of the plurality of heat exchange means, said third controller means being operative to produce a command signal in response to the receipt thereby of the temperature signal produced by said third temperature sensor means when the temperature signal received thereby is representative of other than a predetermined set point temperature value for the fluid exiting from said third one of the plurality of heat exchange means, said third controller means further being operative to provide to said third valve means the command signal produced thereby so as to thereby cause said third valve means to regulate the mass flow rate of hot solids to said third one of the plurality of heat exchange means in order to thereby effect the return of the temperature of the fluid exiting from said third one of the plurality of heat exchange means to the predetermined set point temperature value for the fluid exiting from said third one of the plurality of heat exchange means.

3. In a circulating fluidized bed steam generator, the control system as set forth in claim 2 wherein the plurality of separator means comprise three in number and wherein each of the plurality of separator means comprises a cyclone.

4. In a circulating fluidized bed steam generator, the control system as set forth in claim 2 wherein the plurality of heat exchange means comprise three in number and wherein each of the plurality of heat exchange means comprises a fluidized bed heat exchanger.

5. In a circulating fluidized bed steam generator, the control system as set forth in claim 2 wherein said first valve means, said second valve means and said third valve means each comprises a valve.

6. In a circulating fluidized bed steam generator, the control system as set forth in claim 2 wherein the fluid exiting from said second one of the plurality of heat exchange means comprises superheat steam.

7. In a circulating fluidized bed steam generator, the control system as set forth in claim 2 wherein the fluid exiting from said third one of the plurality of heat exchange means comprises reheat steam.

8. In a circulating fluidized bed steam generator, the control system as set forth in claim 2 wherein said first one of the plurality of heat exchange means is dedicated to evaporative heat transfer duty.

9. In a circulating fluidized bed steam generator, the control system as set forth in claim 2 wherein said second one of the plurality of heat exchange means is dedicated to superheat heat transfer duty.

10. In a circulating fluidized bed steam generator, the control system as set forth in claim 2 wherein said third one of the plurality of heat exchange means is dedicated to reheat heat transfer duty.

* * * * *